US009031438B2

(12) United States Patent
Asaka

(10) Patent No.: US 9,031,438 B2
(45) Date of Patent: May 12, 2015

(54) IMAGE FORMING APPARATUS

(71) Applicant: KYOCERA Document Solutions Inc., Osaka (JP)

(72) Inventor: Hitoshi Asaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 44 days.

(21) Appl. No.: 13/865,830

(22) Filed: Apr. 18, 2013

(65) Prior Publication Data

US 2013/0287422 A1 Oct. 31, 2013

(30) Foreign Application Priority Data

Apr. 25, 2012 (JP) ..... 2012-100485

(51) Int. Cl.
*G03G 15/20* (2006.01)

(52) U.S. Cl.
CPC ..... *G03G 15/2078* (2013.01); *G03G 15/2046* (2013.01); *G03G 2215/0132* (2013.01)

(58) Field of Classification Search
CPC ..... G03G 15/2078; G03G 15/2042; G03G 15/2082
USPC ..... 399/69, 68, 67, 45, 328, 77
See application file for complete search history.

(56) References Cited

U.S. PATENT DOCUMENTS 6,151,462 A * 11/2000 Fukuzawa et al. ..... 399/67
7,664,416 B2 2/2010 Watabe
2006/0204266 A1 9/2006 Watabe
2009/0060548 A1* 3/2009 Souda ..... 399/68
2010/0296828 A1* 11/2010 Hara et al. ..... 399/69

FOREIGN PATENT DOCUMENTS

| | | | |
|---|---|---|---|
| JP | 04-322284 | A | 11/1992 |
| JP | 09-080968 | A | 3/1997 |
| JP | 11-073055 | A | 3/1999 |
| JP | 2004-198871 | A | 7/2004 |
| JP | 2006-251285 | A | 9/2006 |
| JP | 2007-003992 | A | 1/2007 |
| JP | 2008-275771 | A | 11/2008 |
| JP | 2010-190967 | A | 9/2010 |

OTHER PUBLICATIONS

Notice of Rejection mailed by Japan Patent Office on Jul. 8, 2014 in the corresponding Japanese patent application No. 2012-100485—3 pages.

* cited by examiner

*Primary Examiner* — Roy Y Yi
(74) *Attorney, Agent, or Firm* — Knobbe, Martens, Olson & Bear LLP

(57) ABSTRACT

An image forming apparatus includes: an image forming section that forms an image on a recording medium; a fixing section that includes a heat roller with a heater inside and fixes a toner image on the recording medium; a temperature detecting section for detecting the temperature of an end region of the heat roller in a direction of a rotary axis thereof; a control section that controls the operation of the heater based on the detected temperature; and a post-drive time calculating section that calculates a post-drive time for a post-drive of the fixing section after a successive image formation on recording media, depending upon the sizes of the recording media and through a subtraction using a correction factor set according to a condition of conveyance of the recording media. The control section causes the fixing section to perform the post-drive for the calculated post-drive time.

3 Claims, 11 Drawing Sheets

Fig.4

| SIZE | FACTOR |
|---|---|
| A5 | 5 |
| B5 | 2.5 |
| A4 | 0 |
| LETTER | 0 |
| LEGAL | 0 |

Fig.5

| CONTENT OF PROCESSING | CORRECTION FACTOR |
|---|---|
| Change of Paper Feed Stage | -10 |
| Release of Fixing Pressure | Reset |

Fig.8

| SIZE | CORRECTION FACTOR |
|---|---|
| A5 | 0 |
| B5 | 0 |
| A4 | -1 |
| LETTER | -1 |
| LEGAL | -2 |

IMAGE FORMING APPARATUS

INCORPORATION BY REFERENCE

This application claims priority to Japanese Patent Application No. 2012-100485 filed on Apr. 25, 2012, the entire contents of which are incorporated by reference herein.

BACKGROUND

The present disclosure relates to image forming apparatuses and particularly relates to a technique for keeping the temperature of a heat roller of a fixing section uniform across every surface region thereof in a direction of a rotary axis thereof.

A typical image forming apparatus includes a fixing unit for fixing an unfixed toner on a recording paper sheet using a heat roller and a pressure roller (the heat roller and the pressure roller may also be hereinafter collectively referred to as a fixing roller pair). In the fixing unit, when a recording paper sheet passes through a fixing nip position which is an engagement position between the heat roller and the pressure roller, the fixing roller pair causes the phenomenon that a central region thereof in the direction of the rotary axis which comes into contact with the recording paper sheet becomes lower in temperature than end regions thereof out of contact with the recording paper sheet, resulting in a temperature difference between the regions of the fixing roller pair in the direction of the rotary axis. If the next image formation and fixing are performed as the temperature difference remains, the formed image may cause an undesirable color shading in the direction of the rotary axis. Therefore, to eliminate this effect on the next image formation, the fixing unit, after the end of the current image formation, performs a post-drive allowing the fixing roller pair to rotate in the absence of any recording paper sheet before the passage of a next recording paper sheet to reduce the temperature difference between the regions of the fixing roller pair in the direction of the rotary axis and thus stabilize the temperature of the fixing roller pair.

In a fixing unit of the type in which a central region and an end region of a heat roller are provided with their respective temperature sensors, the above post-drive is stopped at the point of time when the temperatures of the central and end regions of the heat roller detected by their respective temperature sensors reach the same temperature. On the other hand, in a fixing unit of the type in which only an end region of the heat roller is provided with a temperature sensor, such as that in an image forming apparatus produced at low cost, it is impossible to control the post-drive based on the determination of whether the central and end regions of the heat roller reach the same temperature. Therefore, the post-drive is performed only for a predetermined period of time after the end of the current image formation.

In an exemplary image forming apparatus intended to eliminate the temperature difference between the regions of the heat roller in the direction of the rotary axis, the on/off ratios of two heaters provided inside the heat roller are determined according to the fixing conditions and the operation of the two heaters is controlled based on these ratios to eliminate the temperature difference between the regions of the heat roller in the direction of the rotary axis.

SUMMARY

The present disclosure proposes as aspects thereof improvement techniques to the above known techniques.

Specifically, an image forming apparatus according to an aspect of the present disclosure includes an image forming section, a fixing section, a temperature detecting section, a control section, and a post-drive time calculating section.

The image forming section is configured to form an image on a recording medium.

The fixing section includes a heat roller internally provided with a heater; and a pressure roller and is configured to fix a toner image transferred to the recording medium by the formation of the image done by the image forming section.

The temperature detecting section is configured to detect the temperature of an end region of the heat roller in a direction of a rotary axis of the heat roller.

The post-drive time calculating section is configured to calculate a post-drive time required for a post-drive to be performed by the fixing section after the image forming section successively forms images on the recording media and the fixing section successively fixes the images on the recording media, wherein the post-drive time is calculated depending upon the sizes of the recording media used in the successive formation of the images and through a subtraction using a correction factor set according to a condition of conveyance of the recording media to the fixing section after the successive formation of the images.

The control section is configured to control the operation of the heater based on the temperature detected by the temperature detecting section and cause the fixing section to perform the post-drive for the post-drive time calculated by using the post-drive time calculating section.

BRIEF DESCRIPTION OF THE DRAWINGS

FIG. 4 is a table showing factors related to different sizes of recording paper sheets;

FIG. 5 is a table showing correction factors related to predetermined operations causing extension of the sheet interval between recording paper sheets being conveyed;

FIG. 8 is a table showing correction factors related to different sizes of recording paper sheets after size change in the second embodiment;

DETAILED DESCRIPTION

Figure 1:
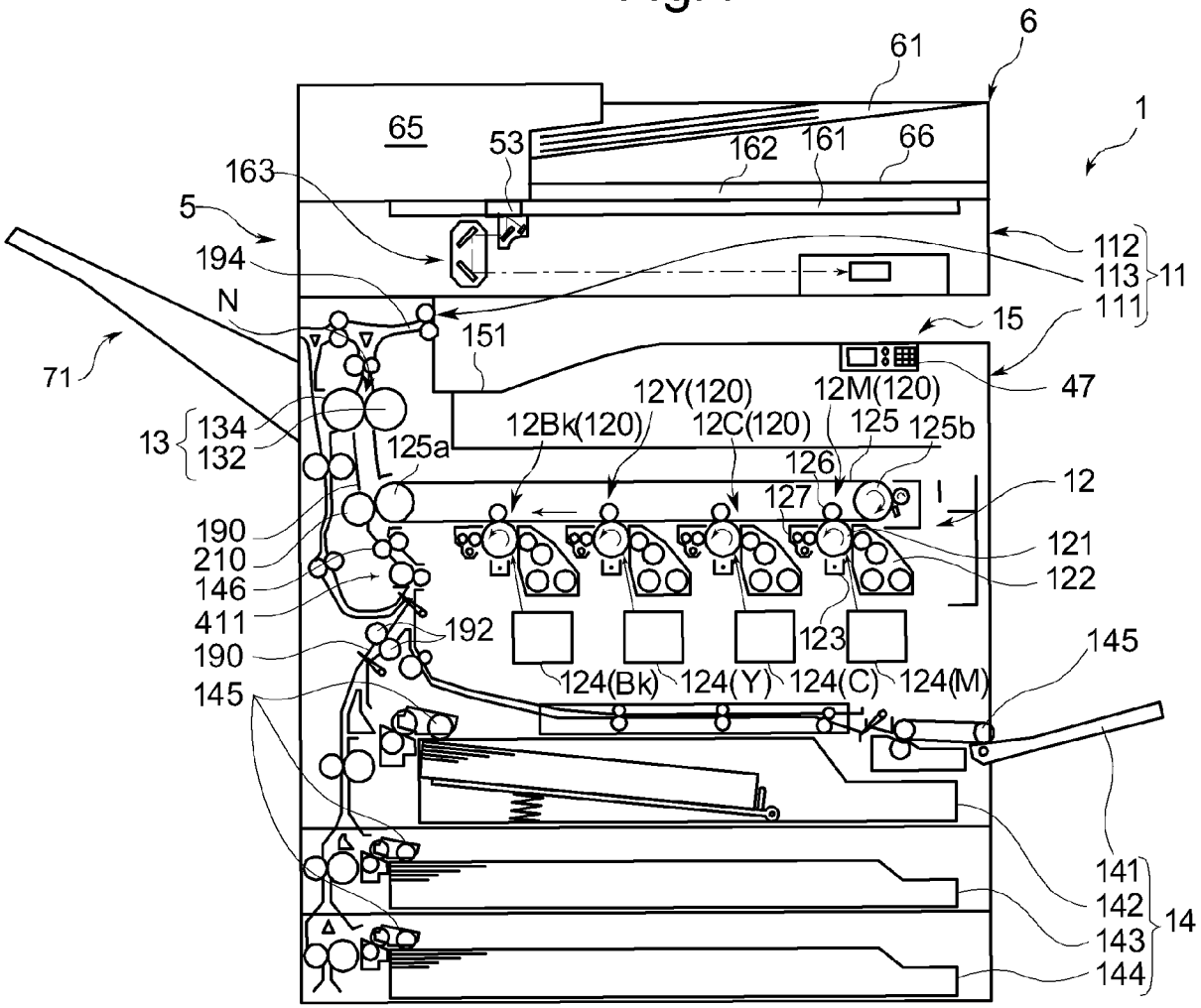
FIG. 1 is a view showing the structure of an image forming apparatus according to an embodiment of the present disclosure.

With reference to the drawings, a description will now be given of an image forming apparatus according to an embodiment corresponding to one aspect of the present disclosure. FIG. 1 is a view showing the structure of the image forming apparatus according to the embodiment of the present disclosure. The image forming apparatus 1 is a multifunctional peripheral having multiple functions including, for example, a copy function, a print function, a scan function, and a facsimile function. The image forming apparatus 1 is made up so that an apparatus body 11 includes an image forming section 12, a fixing section 13, a paper feed section 14, a document feed section 6, and an image reading section 5.

The apparatus body 11 includes a lower body 111, an upper body 112 opposed to and above the lower body 111, and a connecting portion 113 provided between the upper body 112 and the lower body 111. The upper body 112 is provided with the image reading section 5 and the document feed section 6.

The image reading section 5 includes an original glass plate 161 which is fitted to the top of an opening in the upper body 112 and on which an original document is to be placed; an openable/closable original cover 162 for holding the original document placed on the original glass plate 161; and a reader 163 for reading an image of the original document placed on the original glass plate 161.

The document feed section 6 feeds original documents placed on a document placement portion 61 sheet by sheet by the drive of a paper feed roller (not shown), conveys the document to a position facing a document read slit 53 with a clear original glass piece disposed therein by the drive of a conveyance roller (not shown) to allow the reader 163 of the image reading section 5 to read the document through the document read slit 53, and then ejects it to a document ejection portion 66.

The lower body 111 is internally provided with the image forming section 12, the fixing section 13, and the paper feed section 14. The paper feed section 14 includes paper feed cassettes 142, 143, 144 insertable into and removable from the apparatus body 11.

The image forming section 12 performs an image forming operation of forming a toner image on a recording paper sheet P (an example of a recording medium) fed from the paper feed section 14. The image forming section 12 includes a magenta image forming unit 12M, a cyan image forming unit 12C, an yellow image forming unit 12Y, and a black image forming unit 12Bk which are sequentially arranged from upstream to downstream in the running direction of an intermediate transfer belt 125 (hereinafter, each image forming unit is also called an "image forming unit 120" when referred to without distinction). The magenta image forming unit 12M uses magenta toner. The cyan image forming unit 12C uses cyan toner. The yellow image forming unit 12Y uses yellow toner. The black image forming unit 12Bk uses black toner. The image forming section 12 also includes the intermediate transfer belt 125 mounted between a plurality of rollers including a drive roller 125*a* (roller opposed to a secondary transfer roller described below) to be able to endlessly run in a direction of sub scanning for image formation, and a secondary transfer roller 210 which engages against a portion of the intermediate transfer belt 125 wound around the drive roller 125*a* on the outer peripheral side of the intermediate transfer belt 125.

Each image forming unit 120 includes, in combination, a photosensitive drum 121, a developing device 122 operable to supply toner to the photosensitive drum 121, a toner cartridge (not shown) for storing toner, a charging device 123, an exposure device 124, a primary transfer roller 126, and a drum cleaning device 127.

An electrostatic latent image and a toner image along the latent image are formed on the peripheral surface of the photosensitive drum 121. The developing device 122 supplies toner to the photosensitive drum 121. Each developing device 122 is appropriately supplied with toner from the toner cartridge.

The charging device 123 is provided just below the photosensitive drum 121. The charging device 123 electrostatically and uniformly charges the peripheral surface of the associated photosensitive drum 121.

The exposure device 124 is provided below the photosensitive drum 121 and further below the charging device 123. The exposure device 124 irradiates the peripheral surface of the charged photosensitive drum 121 with laser light corresponding to each color based on image data input from a computer or the like or image data acquired by the image reading section 5 to form an electrostatic latent image on the surface of the associated photosensitive drum 121.

The developing device 122 supplies toner to the electrostatic latent image on the peripheral surface of the photosensitive drum 121 rotating in the direction of the arrow to transfer the toner to an exposed portion of the electrostatic latent image, thereby forming a toner image corresponding to the image data on the peripheral surface of the photosensitive drum 121.

The intermediate transfer belt 125 is disposed above the photosensitive drums 121. The intermediate transfer belt 125 is mounted in an endlessly movable manner between the drive roller 125*a* located to the left in FIG. 1 and a driven roller 125*b* located to the right in FIG. 1 and the lower portion of the outer peripheral surface engages against each of the peripheral surfaces of the photosensitive drums 121. The driven roller 125*b* is provided opposite to the drive roller 125*a* and rotates to follow the endless run of the intermediate transfer belt 125. The outer peripheral surface of the intermediate transfer belt 125 is set to an image bearing surface to which a toner image is to be transferred. The intermediate transfer belt 125 is driven by the drive roller 125*a* while making contact with the peripheral surfaces of the photosensitive drums 121. The intermediate transfer belt 125 endlessly runs between the drive roller 125*a* and the driven roller 125*b* while synchronizing with the rotation of each photosensitive drum 121.

Each primary transfer roller 126 is provided at a position opposed to the associated photosensitive drum 121 with the intermediate transfer belt 125 interposed therebetween. A primary transfer bias is applied to the primary transfer roller 126 by an unshown primary transfer bias application mechanism. Thus, the primary transfer roller 126 transfers the toner image formed on the outer peripheral surface of the associated photosensitive drum 121 to the surface of the intermediate transfer belt 125.

A control section 100 (FIG. 2) controls the drive of the primary transfer roller 126 and image forming unit 120 for each color to perform the transfer of a magenta toner image formed by the magenta image forming unit 12M to the surface of the intermediate transfer belt 125, then the transfer of a cyan toner image formed by the cyan image forming unit 12C to the same position of the intermediate transfer belt 125, then the transfer of an yellow toner image formed by the yellow image forming unit 12Y to the same position of the intermediate transfer belt 125, and finally the transfer of a black toner image formed by the black image forming unit 12Bk to superimpose these different colored toner images on each other. Thus, a multicolor toner image is formed on the surface of the intermediate transfer belt 125 (primary transfer of intermediate transfer).

A secondary transfer bias is also applied to the secondary transfer roller 210 by an unshown secondary transfer bias application mechanism. The secondary transfer roller 210 transfers the multicolor toner image formed on the surface of the intermediate transfer belt 125 to a recording paper sheet P conveyed from the paper feed section 14. The secondary transfer roller 210 forms a nip position together with the drive roller 125*a* with the intermediate transfer belt 125 interposed therebetween. At the nip position, the toner image is secondarily transferred to the recording paper sheet P. The recording paper sheet P conveyed along a paper conveyance path 190 is pressed and clamped at the nip position between the intermediate transfer belt 125 and the secondary transfer roller 210 and, thus, the toner image on the intermediate transfer belt 125 is secondarily transferred to the recording paper sheet P.

Each drum cleaning device 127 is provided to the left of the associated photosensitive drum 121 in FIG. 1 and removes residual toner from the peripheral surface of the photosensitive drum 121.

To the left of the image forming section 12 in FIG. 1, a vertically extending paper conveyance path 190 is formed. The paper conveyance path 190 is provided at appropriate positions with pairs of conveyance rollers 192. The pairs of conveyance rollers 192 convey a recording paper sheet P fed out of the paper feed section 14 toward the nip position and the fixing section 13. In other words, the recording paper sheet P is conveyed by a conveyance mechanism composed of the pairs of conveyance rollers 192 arranged at appropriate positions.

Figure 2:
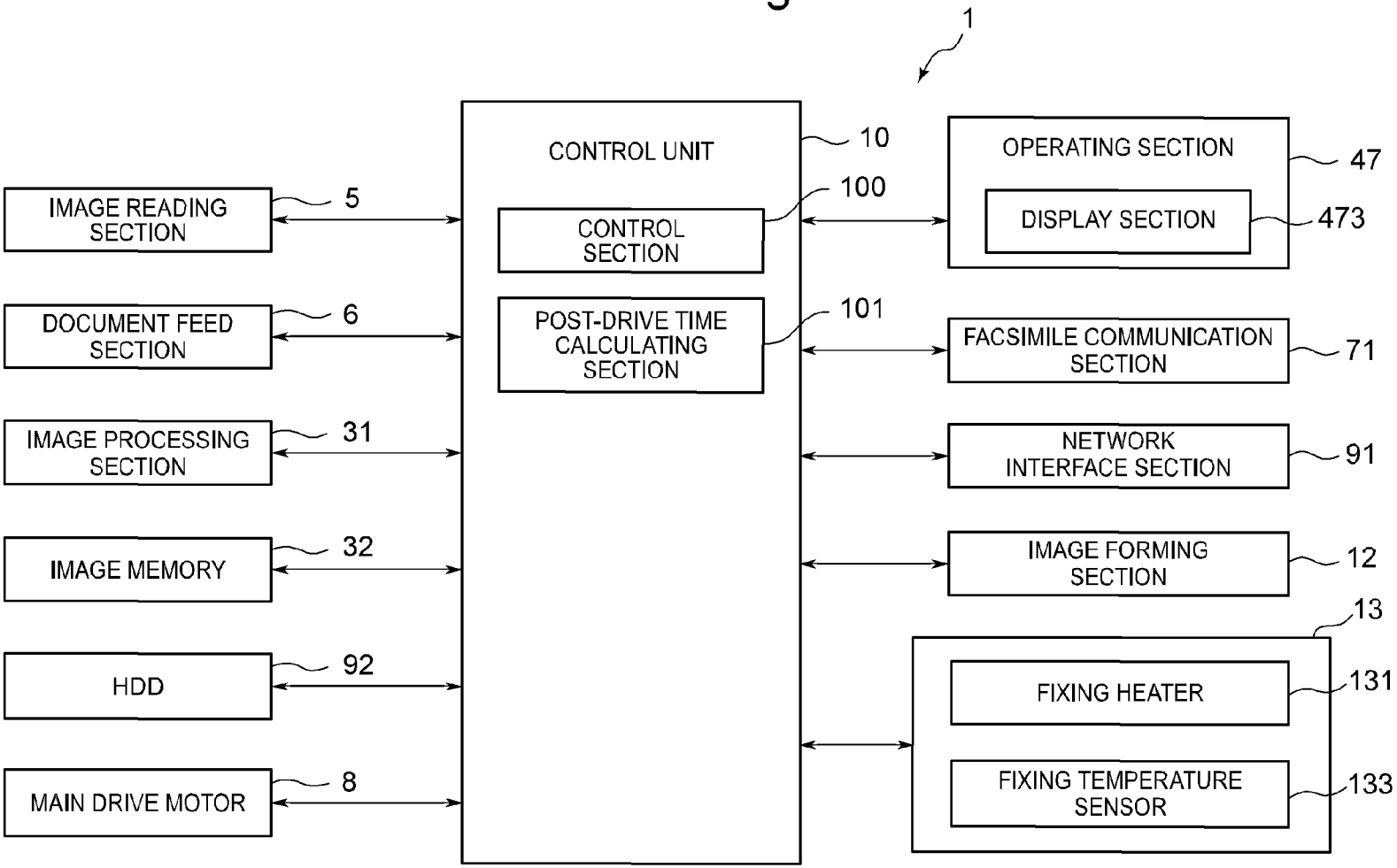
FIG. 2 is a functional block diagram showing an internal structure of the image forming apparatus.

The fixing section 13 includes: a heat roller 132 internally provided with a fixing heater 131 (see FIG. 2); and a pressure roller 134 opposed to the heat roller 132. The heat roller 132 is further provided with a fixing temperature sensor 133 (FIG. 2). The fixing section 13 performs a fixing treatment by applying heat from the heat roller 132 to the toner image on the recording paper sheet P transferred in the image forming section 12 while the recording paper sheet P is passing through the fixing nip position N between the heat roller 132 and the pressure roller 134. The recording paper sheet P on which an image has been fixed by the completion of the fixing treatment passes through a paper output path 194 extended from the top of the fixing section 13 and is ejected to a paper output tray 151 provided on the top of the lower body 111.

The paper feed section 14 includes: a manual feed tray 141 openably and closably provided at a right side wall of the apparatus body 11 in FIG. 1; and the paper feed cassettes 142, 143, 144. Pick-up rollers 145 provided above the paper feed cassettes 142, 143, 144 can feed respective uppermost recording paper sheets P of the paper sheet bundles stored in the paper feed cassettes 142, 143, 144 to the paper conveyance path 190. The paper feed cassettes 142, 143, 144 are disposed at different heights in the lower apparatus body 111. The manual feed tray 141 is disposed on one side of the lower body 111 and therefore located at a horizontally different position from the paper feed cassettes 142, 143, 144. Therefore, the respective conveyance distances from the manual feed tray 141 and paper feed cassettes 142, 143, 144 to the image forming section 12 and the respective conveyance distances from them to the fixing section 13 are different from each other.

A paper output section 15 is formed between the lower body 111 and the upper body 112. The paper output section 15 includes the paper output tray 151 formed on the top surface of the lower body 111. The paper output tray 151 is a tray to which the recording paper sheet P having a toner image formed thereon in the image forming section 12 is ejected after being subjected to a fixing treatment in the fixing section 13.

The structure of the image forming apparatus 1 will next be described. FIG. 2 is a functional block diagram showing the structure of the image forming apparatus.

The image forming apparatus 1 includes a control unit 10. The control unit 10 is composed of a CPU (central processing unit), a RAM, a ROM, a dedicated hardware circuit and so on. Furthermore, the control unit 10 is connected to the image reading section 5, the document feed section 6, an image processing section 31, an image memory 32, the image forming section 12, an operating section 47, a facsimile communication section 71, a network interface section 91, a HDD (hard disk drive) 92 and so on.

The control unit 10 includes the control section 100 and a post-drive time calculating section 101.

The control section 100 governs the overall operation control of the image forming apparatus 1. The control section 100 controls the drive and processing of the above mechanisms necessary to perform the operation control of each of the scan function, the copy function, the print function, and the facsimile function in accordance with a command to execute a job entered by a user via the operating section 47, a network-connected personal computer or the like.

The post-drive time calculating section 101 calculates the post-drive time required for a post-drive of the fixing section 13. The post-drive is a rotary drive which, after the end of the image formation of the image forming section 12 on the recording paper sheet P and the image fixation of the fixing section 13 thereon, the fixing roller pair composed of the heat roller 132 and the pressure roller 134 performs to stabilize the surface temperatures of the fixing roller pair, i.e., to reduce the temperature difference produced between the regions thereof in the direction of the rotary axis.

Generally, when the heat roller 132 heated by the fixing heater 131 and the pressure roller 134 pressed against the heat roller 132 perform a fixing operation of nipping the recording paper sheet P between them to thus fix an unfixed toner image on the recording paper sheet P, the surface temperature of the fixing roller pair drops owing to the contact with the recording paper sheet P having a low temperature. Thus, the surface of the fixing roller pair causes a temperature difference between the regions thereof in the direction of the rotary axis, more specifically, between the central region in contact with the recording paper sheet P and the end regions out of contact with the recording paper sheet P. Therefore, the control section 100 causes the fixing roller pair to perform the above post-drive, i.e., activates a main drive motor 8 to rotate the heat roller 132 and the pressure roller 134 without passing any recording paper sheet P through the nip position between the heat roller 132 and the pressure roller 134. As a result, the fixing roller pair rotates in the absence of any factor contributing to a temperature difference, so that the existing temperature difference is reduced.

When the image forming section 12 performs a successive formation of images on a plurality of recording paper sheets P, the post-drive time calculating section 101 calculates the post-drive time of the fixing section 13 using a factor set for each size of recording paper sheet P being used for the image formation. In calculating the post-drive time, the post-drive time calculating section 101 calculates the post-drive time also using a correction factor set according to a conveyance condition of the recording paper sheet P being conveyed to the nip position N of the fixing section 13 during the successive image formation. Examples of the conveyance condition include: (1) the case where an operation causing extension of the sheet interval between the recording paper sheets P being successively conveyed to the fixing section 13 is performed; and (2) the case where the recording paper sheets P successively conveyed to the fixing section 13 are changed in size from small to large in the width direction which is the direction of the rotary axis of the heat roller 132. The details of the calculation of the post-drive time done by the post-drive time calculating section 101 will be described later.

For example, the control unit 10 functions as the post-drive time calculating section 101 by operating according to a post-drive time calculation program installed in an HDD 92 or an unshown mask ROM. However, the post-drive time calculating section 101 may be constituted not by an operation based on the post-drive time calculation program but by a hardware circuit. Hereinafter, the same applies to the other embodiments unless otherwise specified.

The image reading section 5 is under the control of the control section 100 and includes the reader 163 including a lighting part, a CCD sensor and so on. The image reading section 5 reads an image from an original document by irradiating the document with light from the lighting part and receiving the reflected light on the CCD sensor.

The image processing section 31, if necessary, processes image data of the image read by the image reading section 5. For example, in order that the image read by the image reading section 5 is improved in quality after the formation of an image in the image forming section 12, the image processing section 31 performs a predetermined image processing, such as shading correction.

The image memory 32 provides a region for temporarily storing data of image of the original document read by the image reading section 5 and temporarily storing data to be printed by the image forming section 12.

The image forming section 12, as described previously, forms an image of image data read by the image reading section 5 or the like.

The main drive motor 8 is a drive source for supplying a rotary drive force to rollers of a conveyance system, including the conveyance rollers 192, the pick-up rollers 145, and a resist roller 146. In addition, the main drive motor 8 also supplies a rotary drive force to the fixing roller pair composed of the heat roller 132 and the pressure roller 134 in the fixing section 13.

The operating section 47 includes a touch panel section (not shown) and an operation key section (not shown) which accept user's commands for various operations and processings executable by the image forming apparatus 1. The touch panel section includes a display section 473 formed such as of an LCD (liquid crystal display) with a touch panel.

The facsimile communication section 71 includes a coding/decoding section, a modulation/demodulation section, and an NCU (network control unit), all of which are not illustrated, and performs facsimile communication using a public telephone network.

The network interface section 91 is constituted by a communication module, such as a LAN board, and transfers various data to and from devices (such as personal computers) in a local area via a LAN or the like connected to the network interface section 91.

The HDD 92 is a large storage device capable of storing document images read by the image reading section 5 and the like.

The fixing section 13 includes the fixing heater 131 and the fixing temperature sensor 133. The fixing heater 131 is a current-carrying heating element provided as a heat source inside the heat roller 132. The operation of the fixing heater 131 is controlled by the control section 100. The fixing temperature sensor 133 is formed such as of a thermistor and detects the surface temperature of the heat roller 132. The fixing temperature sensor 133 outputs the detected temperature to the control section 100.

The control section 100 controls the heating of the fixing heater 131, based on the surface temperature of the heat roller 132 acquired from the fixing temperature sensor 133, to give a predetermined fixing temperature to the surface of the heat roller 132.

Figure 3:
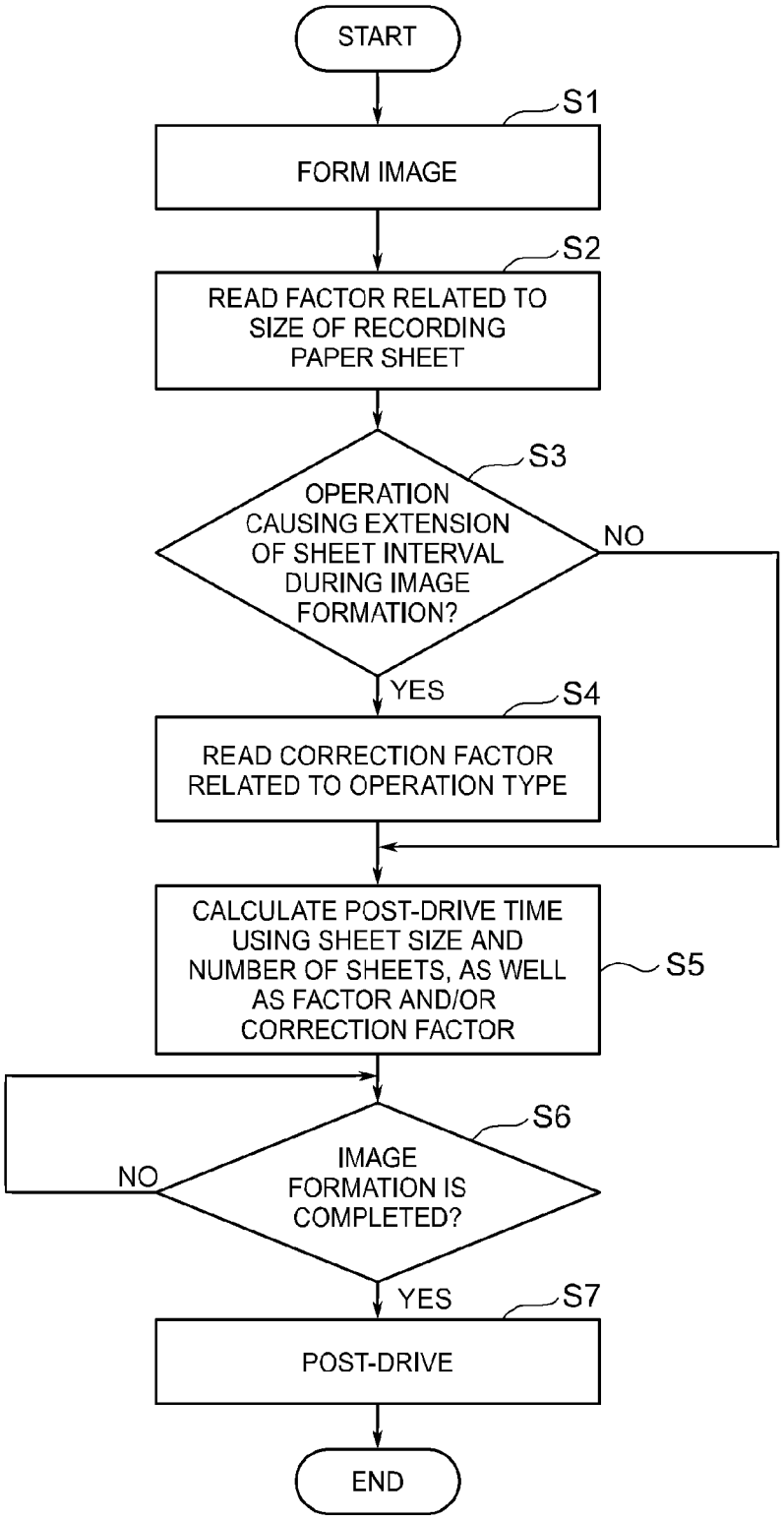
FIG. 3 is a flowchart for illustrating a first embodiment of a processing for calculating a post-drive time of a fixing section in the image forming apparatus.
Figure 6A:
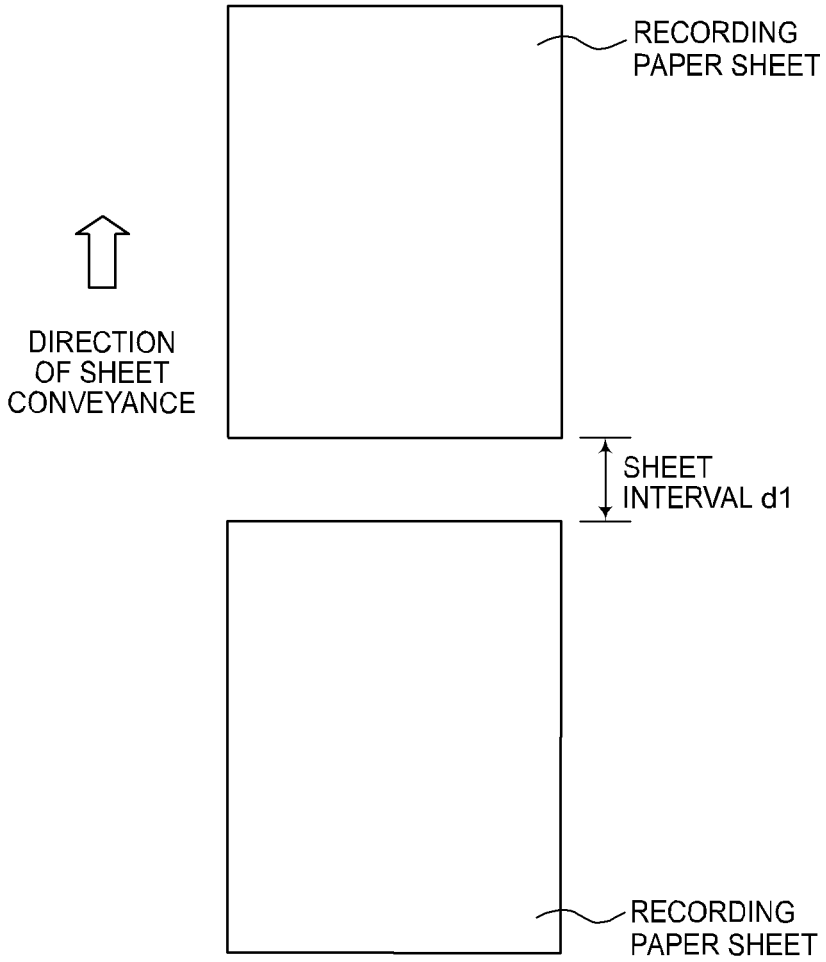
FIG. 6A shows a sheet interval between recording paper sheets when a plurality of recording paper sheets are being successively conveyed to the fixing section.
Figure 6B:
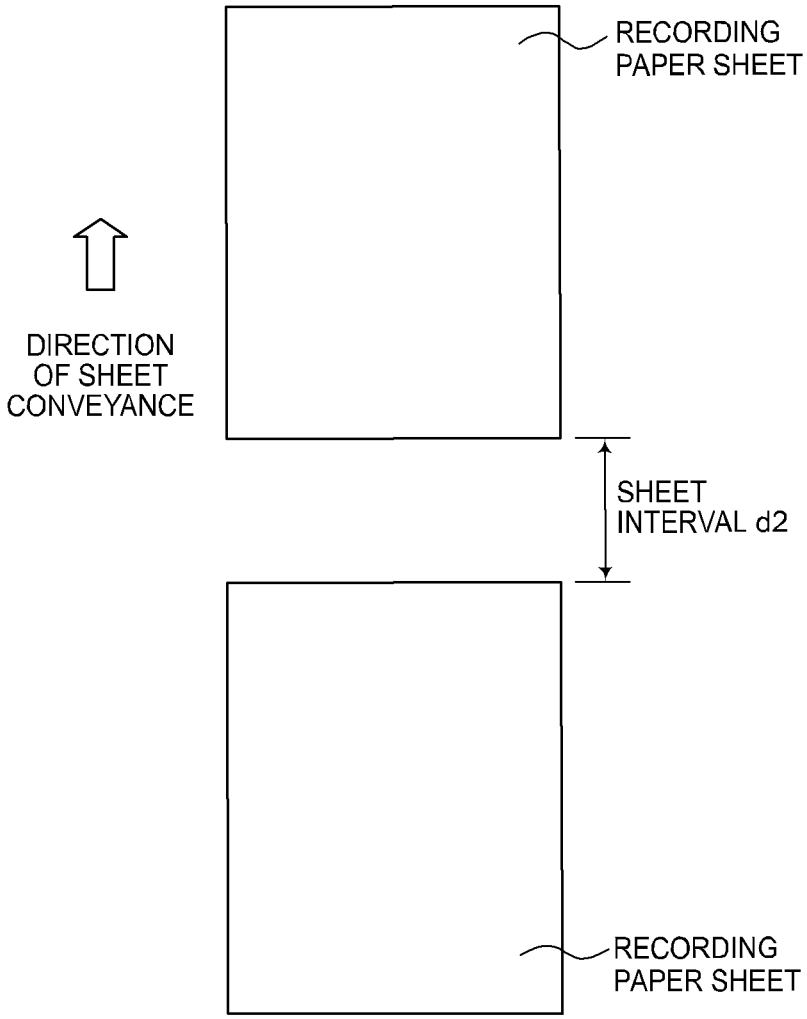
FIG. 6B is a view showing a state of extension of the sheet interval between recording paper sheets when the plurality of recording paper sheets are being successively conveyed to the fixing section.

A description will next be given of a first embodiment of a processing for calculating the post-drive time of the fixing section 13 in the image forming apparatus 1. FIG. 3 is a flowchart for illustrating the first embodiment of the processing for calculating the post-drive time of the fixing section in the image forming apparatus 1. FIG. 4 is a table showing factors related to different sizes of recording paper sheets P. FIG. 5 is a table showing correction factors related to predetermined operations causing extension of the sheet interval between recording paper sheets P being conveyed. FIG. 6A is an example of the sheet interval between recording paper sheets P when a plurality of recording paper sheets P are being successively conveyed to the fixing section 13 and FIG. 6B is a view showing a state of extension of the sheet interval.

It is assumed that, in the image forming apparatus 1, the image forming section 12 and the main drive motor 8 are driven under the control of the control section 100 to perform a successive image formation and fixing operation on a plurality of recording paper sheets P in accordance with an image formation job entered by a user via the operating section 47 or an image formation job entered by a network-connected computer via the network interface section 91 (S1 in FIG. 3). This successive image formation and fixing operation include both of the case where images are formed on a plurality of recording paper sheets P in accordance with a single image formation job and the case where images are formed on a plurality of recording paper sheets P by successively executing a plurality of jobs.

The post-drive time calculating section 101, based on the content of the above image formation job, acquires size information on recording paper sheets P for use in the image formation in the image formation job and reads a factor related to the size of the recording paper sheets P specified by the size information (S2). In the case where the control section 100 has already accepted a plurality of jobs and successively executes the plurality of jobs, the post-drive time calculating section 101 acquires size information on respective sizes of recording paper sheets P for use in the respective image formations in these jobs.

The post-drive time calculating section 101, as shown as an example in FIG. 4, has information showing respective factors related to different sizes of recording paper sheets P. Each factor is previously set for each size of recording paper sheet P, such as by a manufacturer of the image forming apparatus 1. In this embodiment (including both of the first embodiment and a second embodiment below; hereinafter, same applies to the term "this embodiment"), greater factor makes the post-drive time longer. Basically, in setting the factors based on differences in size among recording paper sheets P, for a recording paper sheet P having a smaller length in the direction of the rotary axis of the heat roller 132 and pressure roller 134, i.e., a smaller width in this direction, a factor greater than that for a recording paper sheet P having a larger width, is set.

Each factor may be set in consideration of, besides the size of recording paper sheet P, other elements influencing the surface temperature of the heat roller 132 and pressure roller 134, such as the type of recording paper sheet P and the print speed (number of sheets printed per minute). For example, it is possible that the post-drive time calculating section 101 has respective factors related to different combinations of size of recording paper sheet P and type of recording paper sheet P (such as, for example, plain paper, thick paper or OHP (overhead projector) paper) and the post-drive time calculating section 101 in S2 acquires information not only on the size of the recording paper sheet P but also on the type thereof from the image formation job and reads a factor related to the size and type of the recording paper sheet P.

Furthermore, the post-drive time calculating section 101, based on the content of the image formation job, determines whether or not during the successive image formation a predetermined operation causing extension of the sheet interval (distance) between recording paper sheets P being successively conveyed to the nip position N of the fixing section 13 is performed (S3).

If in S3 the post-drive time calculating section 101 determines that the predetermined operation is performed during the successive image formation (YES in S3), it reads a correction factor related to the predetermined operation (S4).

Examples of the predetermined operation causing extension of the sheet interval (distance) between the recording paper sheets P include, for example, a change from one to another of the paper feed cassettes and a pressure release between the heat roller 132 and pressure roller 134 in the fixing section 13. This embodiment describes an example in which the change from one to another of the paper feed cassettes and the pressure release between the heat roller 132 and pressure roller 134 in the fixing section 13 are the predetermined operations.

The post-drive time calculating section 101, as shown as an example in FIG. 5, has information showing respective correction factors related to the change from one to another of the paper feed cassettes and the pressure release between the heat roller 132 and pressure roller 134 in the fixing section 13, which are the predetermined operations. The correction factors are previously set, such as by a manufacturer of the image forming apparatus 1. Furthermore, different correction factors are set for different operations causing different degrees of extension of the sheet interval. As the operation has a greater degree of contribution to the extension of the sheet interval, it is given a correction factor providing a larger reduction of the post-drive time.

The change from one to another of the paper feed cassettes means a change of the feed source of recording paper sheet P to be conveyed to the image forming section 12 and fixing section 13. Therefore, for example, because of a change of the paper feed cassette to be handled by the paper feed cassette change control of the control section 100, and a change of the conveyance path, the timing to convey the recording paper sheet P from the changed paper feed cassette to the image forming section 12 and fixing section 13 is delayed. Thus, in the fixing section 13, the sheet interval between the recording paper sheet P conveyed from the former paper feed cassette and the recording paper sheet P conveyed from the later paper feed cassette after the cassette change is extended.

For example, suppose that in the case of conveying recording paper sheets P from the same paper feed cassette to the image forming section 12 and the fixing section 13, the distance between the recording paper sheets P in the fixing section 13 is a sheet interval d1 as shown in FIG. 6A. If the conveyance of the recording paper sheet P to the image forming section 12 and the fixing section 13 is delayed by the change from one paper feed cassette to another as described above, the distance between the recording paper sheets P in the fixing section 13 is extended to a sheet interval d2 as shown in FIG. 6B. When in the case where the heat roller 132 and pressure roller 134 in the fixing section 13 are driven into rotation in the absence of recording paper sheet P, the temperature difference between regions in the direction of the rotary axis of these rollers can be reduced. Therefore, since the sheet interval is extended from d1 to d2, the time of rotary drive of the heat roller 132 and pressure roller 134 in the absence of recording paper sheet P will also be extended by a difference between the sheet intervals d1 and d2. So, the post-drive time is reduced, using the above correction factor, by an extended time produced by the extension of the rotary drive and contributing to the reduction of the temperature difference.

Furthermore, for example, in the event of a paper jam during the image formation, the user may execute a fixing pressure release of releasing the pressure between the heat roller 132 and the pressure roller 134 in the fixing section 13. In this release of fixing pressure, the control section 100 stops the heating of the fixing heater 131. Thus, the regions of each of the heat roller 132 and the pressure roller 134 in the direction of the rotary axis totally drop in temperature to reduce the temperature difference between the regions in the direction of the rotary axis. Therefore, to reflect this reduction of the temperature difference on the calculation of the post-drive time, the post-drive time is reduced using the correction factor.

If in S3 the post-drive time calculating section 101 determines that none of the predetermined operations has been performed during the successive image formation (NO in S3), it reads none of the correction factors related to the predetermined operations. In other words, the post-drive time calculating section 101 uses none of the correction factors in calculating the post-drive time.

Subsequently, the post-drive time calculating section 101 calculates the post-drive time using the read factor and, if having read, the correction factor (S5).

A description is given below of how the post-drive time calculating section 101 calculates the post-drive time using the factor shown in FIG. 4 and the correction factor shown in FIG. 5. Here, one-tenth of each factor shown in FIG. 4 is used for the calculation of the post-drive time (seconds).

[Post-Drive Time Calculation 1]

For example, in the case of printing of 20 sheets of A5-size recording paper sheets P, the post-drive time calculating section 101, if calculating the post-drive time without using any correction factor above, reads the factor "5" related to the A5 size from the factor table shown in FIG. 4. In the post-drive time calculating section 101, a value obtained by multiplying the factor "5" by the number of recording paper sheets P printed is the value representing the post-drive time. In this case, factor 5×20 (sheets)=100. Thus, the post-drive time calculating section 101 calculates 100/10=10 (sec) as the post-drive time of the fixing section 13.

[Post-Drive Time Calculation 2]

A comparative example to Post-Drive Time Calculation 1 above is described below using, for example, the case where ten sheets of A5-size recording paper sheets P and then ten sheets of A4-size recording paper sheets P are successively printed. Here, for comparison with the post-drive time calculated in Post-Drive Time Calculation 1 above, the post-drive time calculating section 101 calculates the post-drive time without using any correction factor above. Specifically, the post-drive time calculating section 101 reads the factor "5" related to the A5 size and the factor "0" related to the A4 size from the factor table shown in FIG. 4. In the post-drive time calculating section 101, a total of values obtained by multiplying the individual factors by the respective numbers of recording paper sheets P printed in the same manner as in Calculation 1 above is the value representing the post-drive time. In this case, factor 5×10 (sheets)+factor 0×10 (sheets)=

50. Thus, the post-drive time calculating section 101 calculates 50/10=5 (sec) as the post-drive time of the fixing section 13. Therefore, as a result of the calculation using the factor based on Post-Drive Time Calculation 2, the post-drive time is five seconds shorter than calculated in Post-Drive Time Calculation 1 above.

[Post-Drive Time Calculation 3]

For example, in the case where ten sheets of A5-size recording paper sheets P are conveyed from the paper feed cassette 142 and printed and further ten sheets of A5-size recording paper sheets P are conveyed from the paper feed cassette 143 different from the above paper feed cassette and printed, the post-drive time calculating section 101 reads the factor "5" related to the A5 size from the factor table shown in FIG. 4 and reads the correction factor "−10" related to "Change of Paper Feed Stage" from the correction factor table shown in FIG. 5. In the post-drive time calculating section 101 calculating the post-drive time using the correction factor, a value obtained by adding the correction factor to a total of values obtained by multiplying the factor in FIG. 4 by each of the above numbers of recording paper sheets P printed is the value representing the post-drive time. In this case, factor 5×10 (sheets)+(−10)+factor 5×10 (sheets)=90. Thus, the post-drive time calculating section 101 calculates 90/10=9 (sec) as the post-drive time of the fixing section 13.

[Post-Drive Time Calculation 4]

Suppose that the above correction factor is not used for the calculation of the post-drive time in spite of the above change of paper feed cassette. In the case where ten sheets of A5-size recording paper sheets P are conveyed from the paper feed cassette 142 and printed and further ten sheets of A5-size recording paper sheets P are conveyed from the paper feed cassette 143 different from the above paper feed cassette and printed, the post-drive time calculating section 101 reads the factor "5" related to the A5 size from the factor table shown in FIG. 4 and works out 5×10 (sheets)+5×10 (sheets)=100. Thus, the post-drive time calculating section 101 calculates 100/10=10 (sec) as the post-drive time of the fixing section 13. Therefore, as a result of Post-Drive Time Calculation 3 using the correction factor described above, the post-drive time is one second shorter than that calculated in Post-Drive Time Calculation 4 in which the post-drive time is calculated without the use of the correction factor.

[Post-Drive Time Calculation 5]

Now let us consider that, in the case of Post-Drive Time Calculation 2 (printing of ten sheets of A5-size recording paper sheets P and successive printing of ten sheets of A4-size recording paper sheets P), the A4-size recording paper sheets P are fed from the paper feed cassette different from that storing the A5-size recording paper sheets P. In calculating the post-drive time using the correction factor, the post-drive time calculating section 101 reads the factor "5" related to the A5 size and the factor "0" related to the A4 size from the factor table shown in FIG. 4, reads the correction factor "−10" related to "Change of Paper Feed Stage" from the correction factor table shown in FIG. 5, and works out, using the correction factor "−10", factor 5×10 (sheets)+(−10)+factor 0×10 (sheets)=40 for the post-drive time. Thus, the post-drive time calculating section 101 calculates 40/10=4 (sec) as the post-drive time of the fixing section 13. Therefore, as a result of this Post-Drive Time Calculation 5, the post-drive time is six seconds shorter than that calculated in Post-Drive Time Calculation 1 without the use of the correction factor and the use of the factor of related to A4 size.

[Post-Drive Time Calculation 6]

For example, in the case of printing of 20 sheets of A5-size recording paper sheets P, the post-drive time calculating section 101 multiplies the number of recording paper sheets P printed by the factor "5" related to the A5 size shown in the factor table of FIG. 4 to work out factor 5×20 (sheets)=100. If during this image formation the fixing pressure of the fixing roller pair in the fixing section 13 is released for the purpose of clearing a paper jam caused after the completion of printing by, for example, five recording paper sheets P, the fixing pressure is then restored, and the remaining 15 recording paper sheets P are then printed, the correction factor in this case is "Reset" of the post-drive time related to "Release of Fixing Pressure" as shown in the correction factor table of FIG. 5. Therefore, the post-drive time calculating section 101 makes no calculation of the post-drive time using the factor shown in FIG. 4, as for the printing performed before the release of the fixing pressure. In other words, as for the printing performed before the release of the fixing pressure, the post-drive time calculating section 101 calculates zero seconds as the post-drive time. In this case, the post-drive time calculating section 101 works out 0+5×15 (sheets)=75 covering only the remaining 15 recording paper sheets P and calculates 75/10=7.5 (sec) as the post-drive time of the fixing section 13.

After the successive image formation of the image forming section 12 under the control of the control section 100 is completed (YES in S6) and the last recording paper sheet P has passed through the fixing section 13, the control section 100 drives the main drive motor 8 for the post-drive time calculated in the above manner by the post-drive time calculating section 101, causing the heat roller 132 and the pressure roller 134 to be driven into rotation, i.e., perform a post-drive operation (S7).

For example, in an image forming apparatus in which a temperature sensor is provided only at an end of a heat roller in the direction of the rotary axis and a post-drive is performed for a predetermined period of time, a relatively long post-drive time is set in order to avoid an insufficient post-drive operation. However, the post-drive time is preferably as short as possible while the temperature difference between the central and end regions of the fixing roller pair can be eliminated.

In this first embodiment, an effect of the condition of conveyance of the recording paper sheets P to the fixing section 13 during image forming operation on the temperature difference between regions of each of the heat roller 132 and the pressure roller 134 in the fixing section 13 is considered as a correction factor in calculating the post-drive time. The post-drive time can be calculated through a subtraction depending upon the degree of contribution of the above effect to the reduction of the temperature difference. To achieve this, the fixing temperature sensor 133 is provided only at an end of the heat roller in the direction of the rotary axis. Thus, the image forming apparatus 1 performing a post-drive after the image formation can adequately change the post-drive time based on the content of the image formation to reduce the post-drive time while ensuring the effect of reducing the temperature difference between regions of the fixing roller pair in the direction of the rotary axis.

As described previously, there is known an image forming apparatus intended to eliminate the temperature difference between regions of a fixing roller pair in the direction of the rotary axis, wherein the on/off ratios of two heaters provided inside the heat roller are determined according to the fixing conditions and the operation of the two heaters is controlled based on these ratios. This image forming apparatus can reduce the temperature difference between the regions of the fixing roller pair in the direction of the rotary axis but does not contribute to the reduction of the post-drive time.

Figure 7:
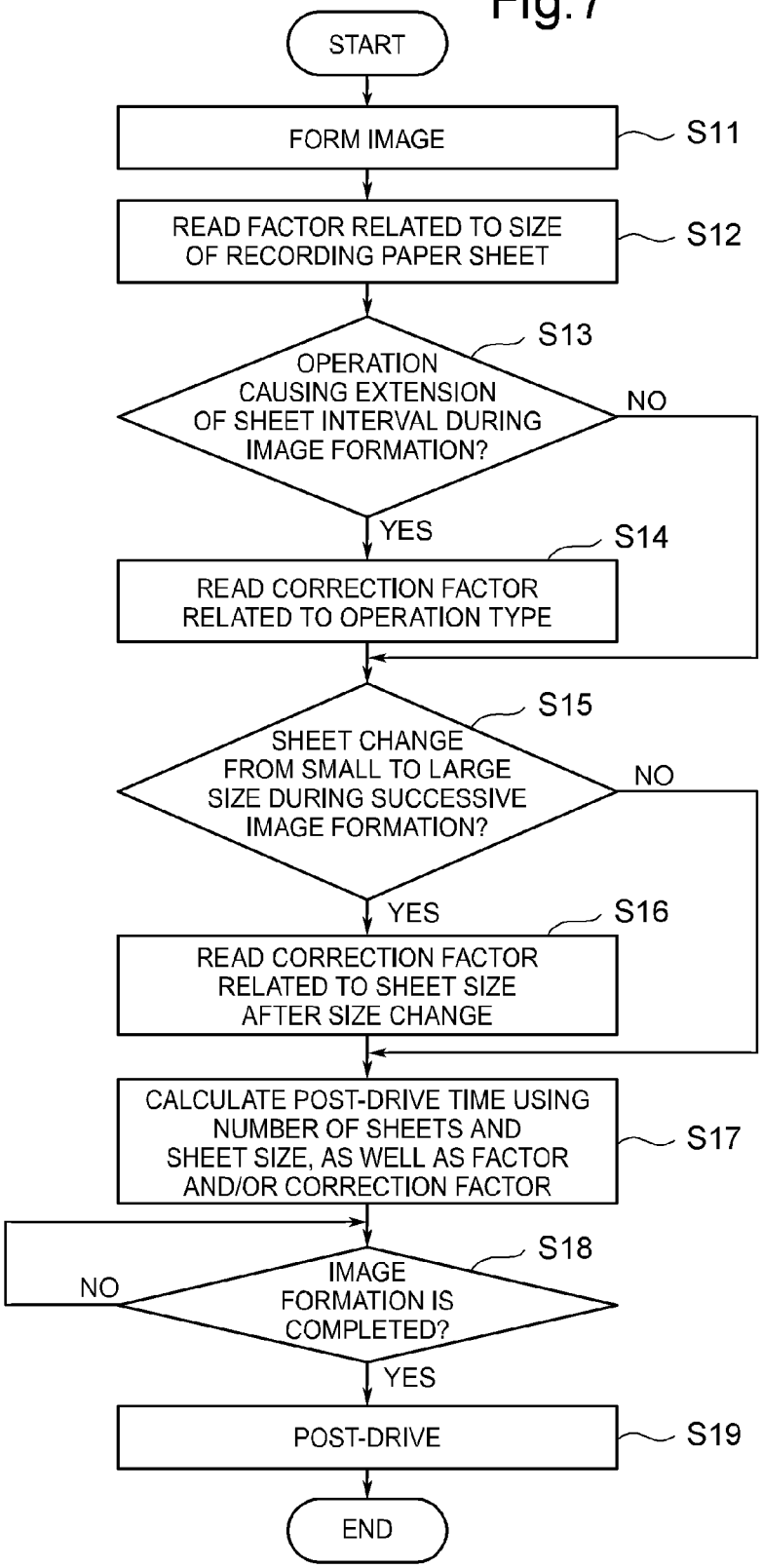
FIG. 7 is a flowchart for illustrating a second embodiment of the processing for calculating the post-drive time of the fixing section in the image forming apparatus.
Figure 9A:
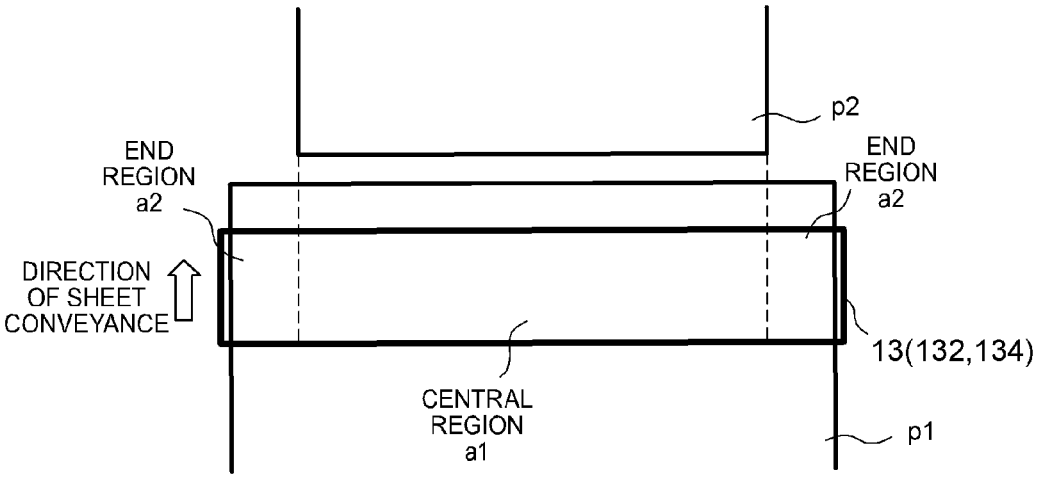
FIG. 9A is a view showing a state of successive passage of a pair of recording paper sheets of different sizes through a fixing roller pair.
Figure 9B:
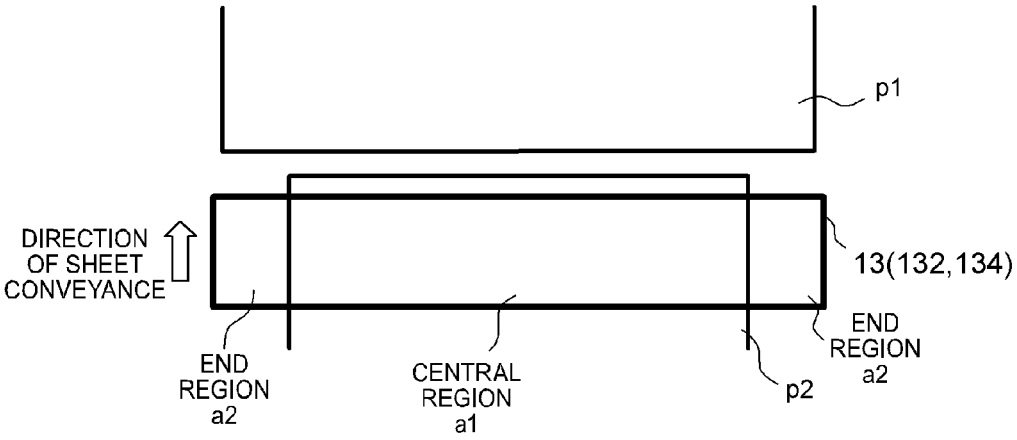
FIG. 9B is a view showing a state of successive passage of another pair of recording paper sheets of different sizes through the fixing roller pair.

A description will next be given of a second embodiment of the processing for calculating the post-drive time of the fixing section 13 in the image forming apparatus 1. FIG. 7 is a flowchart for illustrating the second embodiment of the processing for calculating the post-drive time of the fixing section in the image forming apparatus. Note that the description of the same processings as in the first embodiment described with reference to FIG. 3 is not given hereinafter. FIG. 8 is a table showing correction factors related to different sizes of recording paper sheets P after size change in the second embodiment. FIGS. 9A and 9B are views each showing a state of successive passage of a pair of recording paper sheets P of different sizes through the fixing roller pair.

In the second embodiment, the post-drive time calculating section 101 performs not only the subtraction for the post-drive time using the correction factor in the first embodiment but also a subtraction for the post-drive time using a correction factor related to another conveyance condition which is a size change of recording paper sheet P passing through the fixing section 13 from small to large size. The size change from small to large size means that the recording paper sheet P passing through the fixing section 13 has been changed from one having a small width in the direction of the rotary axis of the fixing roller pair to one having a large width in the same direction.

The post-drive time calculating section 101 reads a correction factor based on the fact that any previously-described predetermined operation causing extension of the sheet interval is performed (S14) and then determines whether or not the recording paper sheets P conveyed to the image forming section 12 and the fixing section 13 during the successive image formation have been changed in size from small to large (S15).

If in S15 the post-drive time calculating section 101 determines that the recording paper sheets P conveyed to the fixing section 13 have been changed in size from small to large (YES in S15), it reads a correction factor related to a large-size recording paper sheet P changed from a small-size recording paper sheet P having been previously conveyed to the fixing section 13 (S16).

A further description is given of the calculation of the post-drive time using the correction factor in relation to a size change of recording paper sheet P from small to large size. The second embodiment describes an example in which recording paper sheets P of various standard paper sizes, including A5, B5, A4, LETTER, and LEGAL, are used for image formation and the recording paper sheet P used is changed from one to another of these sizes. In this example, the subtraction for the post-drive time using the correction factor is performed only when size change is made (a) from A5 to another size or (b) from B5 to another size. The A4, LETTER, and LEGAL sizes of recording paper sheets P have substantially the same width in the direction of the rotary axis of the fixing roller pair. Therefore, the subtraction for the post-drive time using the correction factor is not performed in the case of size change from one to another of these sizes. The post-drive time calculating section 101, as shown as an example in FIG. 8, has information showing respective correction factors related to the above different sizes of recording paper sheets P. The correction factors are previously set, such as by a manufacturer of the image forming apparatus 1.

For example, in the case where the image forming apparatus 1 is configured to allow the printing of up to an A4-size recording paper sheet P, the length of both the rollers in the fixing section 13 in the direction of the rotary axis is selected, according to the width of A4 size in the same direction, to be large enough to fix a toner image on a recording paper sheet P of A4 size which is a maximum size in this case. Therefore, when as shown in FIG. 9A a recording paper sheet p2 having a smaller size than an A4-size recording paper sheet p1 passes through the fixing roller pair, a temperature difference will occur on the surface of the fixing roller pair between a central regional thereof in the direction of the rotary axis in contact with the recording paper sheet p2 and end regions a2 thereof in the same direction out of contact with the recording paper sheet p2. On the other hand, when an A4-size recording paper sheet p1 having a width approximating the length of the fixing roller pair in the direction of the rotary axis passes through the fixing roller pair, the recording paper sheet p1 comes into contact with all of the central regional and the end regions a2, so that the temperature difference above is less likely to occur. Therefore, when the recording paper sheets P conveyed to the fixing section 13 have been changed from those having a small width to those having a large width, the temperature difference on the surface of the fixing roller pair tends to be eliminated. To reflect this phenomenon on the calculation of the post-drive time, the post-drive time calculating section 101 performs a subtraction for the post-drive time using a correction factor related to the size of recording paper sheet P after the size change.

As described above, the temperature difference tends to be reduced when a large size of recording paper sheet P passes through the fixing nip position N in the fixing section 13. Therefore, if the recording paper sheets P conveyed to the fixing section 13 have been changed in size from large to small (NO in S15), no subtraction for the post-drive time using the correction factor is performed in S17 shown in FIG. 7.

For example, as shown in FIG. 9B, if the recording paper sheet P passing through the fixing nip position N in the fixing section 13 has been changed from an A4-size recording paper sheet p1 to an A5-size recording paper sheet p2, the region of the heat roller in the direction of the rotary axis out of contact with the recording paper sheet P becomes larger than in the case of the former recording paper sheet P before the size change, which makes a temperature difference more likely and thus makes it necessary to secure a sufficient post-drive time. Therefore, no subtraction for the post-drive time using the correction factor is performed.

A description is given below of how the post-drive time calculating section 101 calculates the post-drive time using the correction factor shown in FIG. 8. Also regarding the correction factors shown in FIG. 8, one-tenth of each correction factor is used for the calculation of the post-drive time (seconds).

[Post-Drive Time Calculation 7]

For example, in the case of successive printing of ten sheets of A5-size recording paper sheets P and then ten sheets of A4-size recording paper sheets P stored in a paper feed cassette different from that for the A5-size recording paper sheets P, the post-drive time calculating section 101 reads the factor "5" related to the A5 size and the factor "0" related to the A4 size from the factor table shown in FIG. 4. Furthermore, the post-drive time calculating section 101 also reads the correction factor "−10" related to "Change of Paper Feed Stage" from the correction factor table shown in FIG. 5. In this case, since the recording paper sheets P passing through the fixing roller pair in the fixing section 13 have been changed in size from small to large, the post-drive time calculating section 101 further reads the correction factor "−1" related to the A4 size after the size change from the correction factor table shown in FIG. 8. Thus, the post-drive time calculating section 101 works out factor 5×10 (sheets)+factor 0×10 (sheets)+(−10)+(factor −1×10 (sheets))=30 and then calculates 30/10=3

(sec) as the post-drive time of the fixing section 13. Therefore, in the case of correction of the post-drive time using the correction factor in relation to a size change of recording paper sheet P from small to large size, the post-drive time is one second shorter than without the above correction (than in Post-Drive Time Calculation 5).

[Post-Drive Time Calculation 8]

On the other hand, in the case of successive printing of ten sheets of A4-size recording paper sheets P and then ten sheets of A5-size recording paper sheets P stored in a different paper feed cassette, the post-drive time calculating section 101 reads the factor "5" related to the A5 size and the factor "0" related to the A4 size from the factor table shown in FIG. 4 and also reads the correction factor "−10" related to "Change of Paper Feed Stage" from the correction factor table shown in FIG. 5. In this case, however, the post-drive time calculating section 101 uses none of the correction factors shown in the correction factor table of FIG. 8 because the recording paper sheets P passing through the fixing roller pair in the fixing section 13 have been changed in size from large to small, and works out factor 0×10 (sheets)+5×10 (sheets)+(−10)=40. Thus, the post-drive time calculating section 101 calculates 40/10=4 (sec) as the post-drive time of the fixing section 13. In other words, because the size change in this case does not contribute to the reduction of the temperature difference between regions of the fixing roller pair in the direction of the rotary axis, no subtraction for the post-drive time using the correction factor shown in FIG. 8 is performed.

After the successive image formation of the image forming section 12 under the control of the control section 100 is completed (YES in S18) and the last recording paper sheet P has passed through the fixing section 13, the control section 100 drives the main drive motor 8 for the post-drive time calculated in the above manner by the post-drive time calculating section 101, causing the heat roller 132 and the pressure roller 134 to be driven into rotation, i.e., perform a post-drive operation (S19).

In the above cases, whether or not in the course of the successive image formation the recording paper sheets P have been changed in size from small to large is determined in S15. However, the processing in S15 may not be performed, and instead of this, the same effect as the processing in S15 may be obtained so that in the post-drive time calculating section 101 the correction factors related to the sizes of recording paper sheet P after size change are previously set at values allowing reduction of the post-drive time only when the recording paper sheets P have been changed in size from relatively small to large and having no effect on the post-drive time when the recording paper sheets P have been changed from and to substantially the same size. For example, the correction factors related to the sizes of recording paper sheet P shown in FIG. 8 are set at values that, even without the processing of S15, do not provide any subtraction for the post-drive time when the recording paper sheets P have been changed in size from large to small.

In the above cases, the subtraction for the post-drive time is performed using the correction factors set in consideration of the width of the recording paper sheet P in the direction of the rotary axis of the fixing roller pair. However, if the recording paper sheet P after size change is of relatively large size and the length thereof in the direction of conveyance orthogonal to the direction of the rotary axis is large, a correction factor giving a large degree of subtraction for the post-drive time may be set. For example, in the case of printing of a LEGAL-size recording paper sheet, the surface area of the heat roller out of contact with the recording paper sheet passing through the fixing roller pair is extremely small and this state is continued for the length of the LEGAL-size recording paper sheet. Thus, when the LEGAL-size recording paper sheet longer in the direction of conveyance than different-sized recording paper sheets P passes through the fixing roller pair, the degree of contribution to the reduction of the temperature difference between regions in the direction of the rotary axis increases. Therefore, the correction factor, in the case where the recording paper sheet P after size change is of LEGAL size, may be set at a value giving a larger degree of subtraction for the post-drive time than where the recording paper sheet P after size change is of another size. The correction factors related to various sizes of recording paper sheets P shown in FIG. 8 represent an example in which the correction factor, in the case where the recording paper sheet P after size change is of LEGAL size, is set at a value giving a larger degree of subtraction for the post-drive time than where the recording paper sheet P after size change is of another size.

The second embodiment described above, like the first embodiment, shows an example of the subtraction for the post-drive time using a correction factor related to one of the predetermined operations causing extension of the sheet interval (S13, S14). However, the post-drive time may be calculated, without the subtraction for the post-drive time using a correction factor related to one of the predetermined operations, using only a factor shown as an example in FIG. 4 and related to the size of recording paper sheet P and a correction factor shown as an example in FIG. 8 and related to the case where the recording paper sheets P conveyed to the fixing section 13 have been changed in size from small to large.

In the second embodiment, a size change of recording paper sheet P conveyed to the fixing section 13 from small to large size, which tends to reduce the temperature difference between regions of the fixing roller pair in the direction of the rotary axis, is reflected as a correction factor on the calculation of the post-drive time. Thus, the post-drive time can be adequately changed based on the content of the image formation and depending upon the degree of contribution of the size change to the reduction of the temperature difference, so that the post-drive time can be further reduced while the effect of reducing the temperature difference between regions of the fixing roller pair in the direction of the rotary axis can be ensured.

The present disclosure is not limited to the above embodiments and can be modified in various ways. Although the description of the above embodiments is given taking a printer as an example of the image forming apparatus according to the present disclosure, the example is merely illustrative and the image forming apparatus according to the present disclosure may be an image forming apparatus other than printers, such as a copier or a facsimile machine, or may be other image forming apparatuses, such as a multifunctional peripheral having multiple functions including, for example, a copy function, a facsimile function, a scan function, and a print function.

The structures and processings shown in the above embodiments with reference to FIGS. 1 to 9 are merely illustrative of the present disclosure and not intended to limit the present disclosure to the above particular structures and processings.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

an image forming section configured to form an image on a recording medium;

a fixing section which includes a heat roller internally provided with a heater, and a pressure roller and is configured to fix a toner image transferred to the recording medium by the formation image done by the image forming section;

a temperature detecting section configured to detect the temperature of an end region of the heat roller in a direction of a rotary axis of the heat roller;

a control section configured to control the operation of the heater based on the temperature detected by using the temperature detecting section; and a post-drive time calculating section configured to calculate a post-drive time required for a post-drive to be performed by the fixing section after the image forming section successively forms images on recording media and the fixing section successively fixes the images on the recording media, the post-drive time calculating section calculating the post-drive time depending upon the sizes of the recording media used in the successive formation of the images and through a subtraction using a correction factor set according to a condition of conveyance of the recording media to the fixing section after the successive formation of the images, wherein the control section causes the fixing section to perform the post-drive for the post-drive time calculated by the post-drive time calculating section, and wherein the post-drive time calculating section applies, as an element constituting the condition of conveyance, the case where a predetermined operation causing extension of the distance between the recording media being successively conveyed to the fixing section is performed.

2. The image forming apparatus according to claim 1, further including a plurality of paper feed cassettes from which the recording medium is fed to the image forming section, wherein the post-drive time calculating section stores a change from one to another of the paper feed cassettes as the predetermined operation and calculates the post-drive time through a subtraction using the correction factor related to the change from one to another of the paper feed cassettes.

3. The image forming apparatus according to claim 1, wherein the post-drive time calculating section stores a release of fixing pressure between the heat roller and the pressure roller as the predetermined operation and calculates the post-drive time through a subtraction using the correction factor related to the release of fixing pressure.

* * * * *